US005626692A

United States Patent [19]

Rohatgi et al.

[11] Patent Number: 5,626,692

[45] Date of Patent: May 6, 1997

[54] METHOD OF MAKING AN ALUMINUM-BASE METAL MATRIX COMPOSITE

[75] Inventors: Pradeep K. Rohatgi, Milwaukee, Wis.; James A. E. Bell, Oakville; Thomas F. Stephenson, Toronto, both of Canada

[73] Assignee: INCO Limited, Toronto, Canada

[21] Appl. No.: 204,030

[22] Filed: Mar. 1, 1994

Related U.S. Application Data

[60] Division of Ser. No. 33,250, Mar. 16, 1993, abandoned, which is a continuation-in-part of Ser. No. 871,274, Apr. 21, 1992, abandoned.

[51] Int. Cl.[6] ..... C22F 1/04

[52] U.S. Cl. ..... 148/538; 148/437; 148/549; 164/66.1; 164/97; 420/528; 420/590; 428/614

[58] Field of Search ..... 148/437, 438, 148/439, 440, 538, 549; 420/528, 590; 428/614; 164/66.1, 97

[56] References Cited

U.S. PATENT DOCUMENTS

| | | | |
|---|---|---|---|
| 3,885,959 | 5/1975 | Badia et al. | 148/437 |
| 5,187,021 | 2/1993 | Vydra et al. | 428/607 |

FOREIGN PATENT DOCUMENTS

| | | |
|---|---|---|
| 900216 | 5/1972 | Canada . |
| 56-116851 | 9/1981 | Japan . |
| 58-81948 | 5/1983 | Japan . |
| 58-147532 | 9/1983 | Japan . |
| 1-230737 | 9/1989 | Japan . |

*Primary Examiner*—David A. Simmons
*Assistant Examiner*—Robert R. Koehler
*Attorney, Agent, or Firm*—Blake T. Biederman; Edward A. Steen

[57] ABSTRACT

The invention provides an aluminum-base composite material. The aluminum-base material contains a uniform distribution of carbide particles and lubricating phase particles such as carbon or graphite. The carbide particles increase hardness for improved wear resistance. The lubricating phase particles provide improved wear resistance and especially improve unlubricated wear resistance under increased loads. Finally, a dispersoid of nickel aluminide intermetallic phase may also be used to provide additional hardness and wear resistance. The composite is formed by introducing carbide particles and lubricating phase such as graphite into a molten aluminum alloy to neutraliize buoyancy and to form an aluminum-base mixture. Mixing the aluminum-base mixture to uniformly distribute carbide and carbon particles throughout the molten aluminum. Carbide and carbon particles counteract each other to remain uniformly distributed throughout the aluminum-base alloy despite prolonged holding or cooling times.

17 Claims, 1 Drawing Sheet

METHOD OF MAKING AN ALUMINUM-BASE METAL MATRIX COMPOSITE

This is a divisional application of U.S. Ser. No. 08/033,250, filed Mar. 16, 1993, now abandoned. U.S. Ser. No. 08/033,250 was a continuation-in-part application of U.S. Ser. No. 07/871,274, filed Apr. 21, 1992, now abandoned.

BACKGROUND OF THE ART AND PROBLEM

Beneficial unlubricated wear resistance properties obtained by adding graphite to aluminum alloys have been known for several years. However, poor wetting between aluminum-base alloys and graphite prevents formation of adequate graphite/aluminum bonding. Furthermore, graphite particles, having a density of 1.8 g/cm$^3$, have a tendency to "float" in the molten aluminum (density 2.7 g/cm$^3$). Badia et al, in U.S. Pat. No. 3,753,694, disclosed a method of subjecting nickel coated graphite to a vortex in an aluminum bath in an attempt to overcome casting problems. When using the method of Badia et al, continued mixing in combination with solidification prior to dissolution of the nickel coating is required to limit flotation of graphite particles. In fact, the main reason the vortex method has never received widespread use is that during casting, the nickel coatings quickly and completely dissolve leaving uncoated graphite particles that float in the melt. The castings resulting from the vortex method have a distinct heterogenous and unworkable distribution of graphite particles.

Alternative substitutes for metal coatings such as copper and nickel that provide wetting with aluminum have been attempted. Rohatgi et al., in U.S. Pat. No. 4,946,647 and Komura et al, in U.S. Pat. No. 4,383,970 disclose use of additives to promote wetting of carbon particulate with aluminum. However, the methods have not achieved commercial acceptance due to the graphite density in relation to the aluminum alloy remaining a problem. Despite the improved wetting achieved by addition of additives, graphite particles continue to float during casting and solidification.

Aluminum-silicon carbide composites have been proposed for use in several automotive and aerospace applications. The problem with casting aluminum-silicon carbide composites is that silicon carbide tends to settle to the bottom of the melt during holding of the melt or during prolongated solidification. The settling of silicon carbide particles in aluminum-base alloys tends to limit holding times of molten metals. Furthermore, the settling of silicon carbide limits the maximum cross-section that may be cast for aluminum-base silicon carbide composites.

Skibo et al., in U.S. Pat. No. 4,865,806, teach oxidizing of silicon carbide particles surfaces prior to mixing the oxidized particles in an aluminum alloy to promote wetting of the silicon carbide particles by the alloy. Certain alloy additions which promote the wetting of silicon carbide particles are also preferred. Stepped alloying has also been proposed by Skibo et al in U.S. Pat. No. 5,083,602. Badia et al, in U.S. Pat. No. 3,885,959, also produced silicon carbide particulate reinforced melts by mixing nickel coated silicon carbide with molten aluminum. In the Skibo case the surface oxidation and the alloying elements in the melt did not materially alter the 3.2 g/cm$^3$ density o,f the silicon carbide particles or the density of the aluminum melt. Likewise in the Badia method, the nickel dissolves off the SiC in to the melt and silicon carbide particle specific gravity remains unchanged. Having an opposite effect in comparison to graphite particles in Al alloys, silicon carbide particles (density 3.2 g/cm$^3$) tend to settle during casting and solidification of aluminum composite alloys.

Many powder metallurgy routes have also been used to make hybrid composite materials. For example, A. Shibata in U.S. Pat. No. 3,782,930, proposes a partially molten reactive sintering process wherein TiC and graphite are formed. Also, Hagiwara et al, in U.S. Pat. No. 4,959,276, disclose $Al_2O_3$ + graphite particulate aluminum matrix composites formed by blending powders of the three constituents and hot extruding or pressing. While these powder methods may form a desirable end product, they are prohibitively expensive to produce.

In addition, methods such as thixomolding and thixocasting have been proposed for making hybrid metal matrix composites, see for example Albertson et al, U.S. Pat. No. 4,409,298. In these methods, the melt is semi-solid which requires a difficult mixing step with novel equipment, high pressure casting equipment, or high pressure injection equipment to avoid porosity. Furthermore, thixomolding and thixocasting, suitable for only a few alloys, require precision temperature control.

Another method for producing hybrid metal matrix composite materials is by liquid infiltration of performs of carbon plus other fibers by a molten aluminum alloy. For example, SAE 890557 and Ushio et al in U.S. Pat. No. 5,041,340 each disclose liquid infiltration techniques. In patent application U.S. Ser. No. 07/896,207, Bell et al teach reducing injection pressure required to penetrate a carbon phase preform by prior nickel coating. The method of Bell et al reduces the high equipment cost associated with the technology of Ushio et al. The present invention, however, teaches a method by which a particulate reinforced composite can be processed to provide a uniform distribution of reinforcing phase.

It is an object of this invention to provide a method of forming cast aluminum-base carbide composites (such as silicon carbide) having a uniform carbide distribution in a manner which allows holding the composite in a molten state for extended times without agitation or mixing or with considerably reduced agitation or mixing.

It is a further object of this invention to provide a method of forming cast aluminum-base carbon rich phase (such as graphite) composites having a uniform carbon phase distribution in a manner which allows holding the composite in a molten state for extended times without agitation or mixing or with considerably reduced agitation or mixing.

It is a further object of this invention to provide an aluminum-base composite having improved wear resistance.

SUMMARY OF THE INVENTION

The invention provides an aluminum-base composite material. The aluminum-base material contains a uniform distribution of carbide particles and lubricating phase particles such as carbon or graphite. The carbide particles increase modulus, strength and hardness for improved wear resistance. The lubricating phase particles provide improved wear resistance and especially improve unlubricated wear resistance under increased loads. Finally, a dispersoid of nickel aluminide intermetallic phase may also be used to provide additional hardness and wear resistance.

The composite is formed by introducing carbide particles and lubricating phase such as graphite, into a molten aluminum alloy to form an aluminum-base mixture. Mixing the aluminum-base mixture to uniformly distribute carbide particles and carbon throughout the molten aluminum. Carbide and carbon particles counteract each other to neutralize buoyancy and to remain uniformly distributed throughout the aluminum-base alloy despite prolonged holding or cooling times. This prolonged holding or cooling time provides a commercially acceptable method of forming Al-base, SiC/Graphite Composites.

DESCRIPTION OF PREFERRED EMBODIMENT

Figure 1:
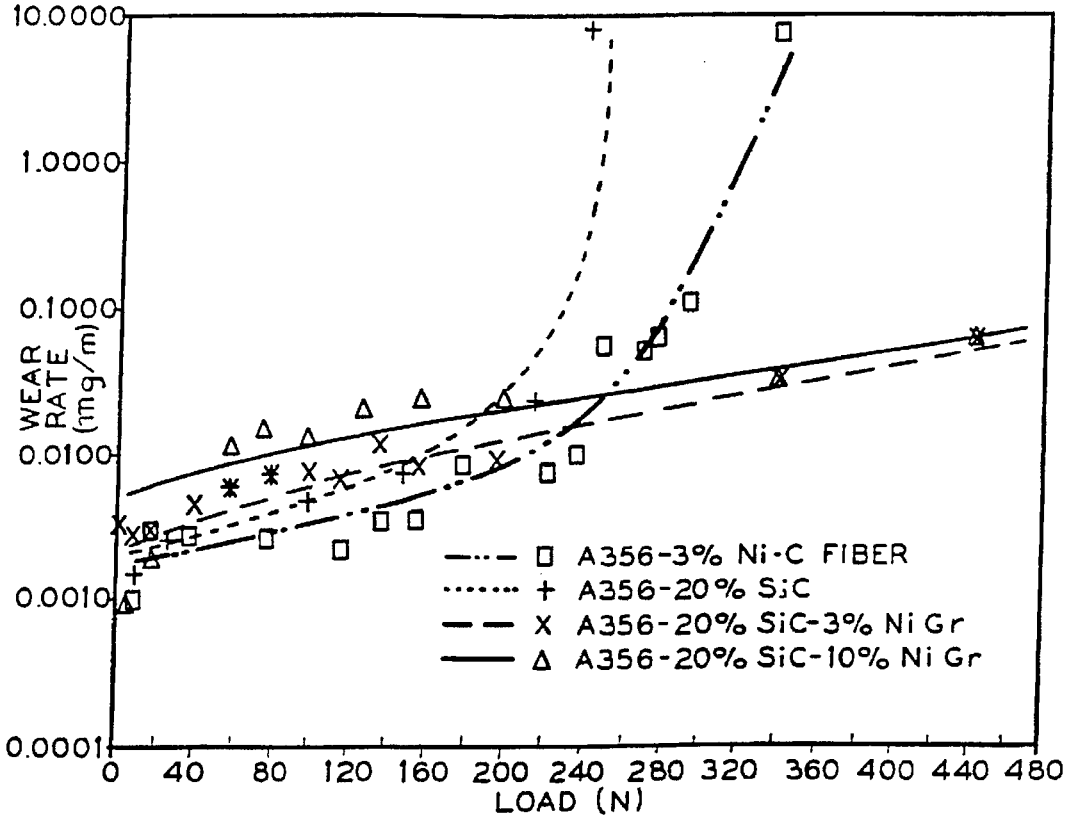
FIG. 1, is a plot of wear rate versus load comparing aluminum alloy 356 as modified with 3% Ni—C fiber, 20% SiC, 20% SiC - 3% NiGr and 20% SiC -10% NiGr for a G77 Block-on-Ring test.

It has been discovered that the presence of both silicon carbide particulate and graphite particulate in molten aluminum has a mutually beneficial effect with regard to homogeneity of the particles in the final casting. Furthermore, the resulting product is particularly useful because the cast metal matrix hybrid composite has unique wear properties, i.e. better in dry unlubricated wear than either of the particles by themselves in the same metal matrix composite. Finally, the mixture of carbide and carbon rich phase particles provides a slurry with neutralized buoyancy to allow prolonged holding and solidification times without adversely affecting homogeneity.

In particular, the invention provides a method of forming an aluminum-base composite strengthened with carbide particles and carbon containing phase. SiC and nickel coated carbon are added to an aluminum-base alloy and mixed. The lubricating or carbon rich phase particles advantageously is metal coated with copper, copper-base alloy, nickel or nickel-base alloy to effectively wet and enter aluminum. Most advantageously, the carbon is coated with nickel. Most advantageously, the nickel coating arises from a form of chemical deposition such as nickel carbonyl decomposition. Alternatively, uncoated lubricating phase may be added directly to the composite. Advantageously, wetting agents may be added directly to the melt when uncoated lubricating phase is used. Lubricating phase particles and carbide particles are characterized as inducing irregularly shaped particulate structures and short cylindrical fibers for purposes of this specification. The lubricating phase is preferably a material such as carbon, graphite or a mixture thereof. Most preferably, graphite is added as the lubricating phase. The carbide phase may be a compound such as silicon carbide, titanium carbide, tungsten carbide, vanadium carbide, or a combination thereof. An amount of up to 40 weight percent carbide particulate may be present in the composite. Most advantageously, silicon carbide is used. Carbide particulate is advantageously added in an amount from 5 to 30 weight percent. All compositions contained in this specification are expressed in weight percent. At least 5 weight % carbide particulate is required to prevent graphite particles from floating. Most advantageously, 15 to 25 weight percent carbide particulate is added. An addition, of 15 weight percent silicon carbide drastically improves wear resistance. Excess carbide particulate adversely decreases ductility and toughness of the composite. As little as 0.5, 1 or 2 weight percent lubricating phase may be used to improve wear-resistance. Lubricating phase is advantageously introduced in an amount of 3–30 weight percent. Advantageously, the composite may contain 0.5 to 30 or 2 to 20 weight percent lubricating phase. Most advantageously, at least 3 or 10 weight percent lubricating phase is added to increase wear-resistance under increased unlubricated loads. Furthermore, the weight percent lubricating phase is most advantageously limited to 20 or 25 weight percent to limit adverse decreasing of hardness and strength.

After the silicon carbide and carbon phase are added the mixture is stirred to distribute these additives and to dissolve the metal coating when a metal coating is used. Advantageously, nickel present in the metal coating is dissolved in an aluminum alloy matrix to form nickel aluminide dispersoids such as $NiAl_3$ in platelet and needle form. Most advantageously, the total nickel present in the aluminum is sufficient to precipitate nickel aluminide. Alternatively, additional nickel may be added by using nickel coated silicon carbide or by adding nickel directly into the aluminum matrix. Most advantageously, in order to pour the composite mixture, total weight percent carbide particles and lubricating phase is less than 60 weight percent. Where a copper or copper-base alloy metal coating is used, the resulting aluminum-base alloy becomes age hardenable upon dissolution of copper into the aluminum-base matrix. Alternatively, alloys may be solidified directly in a crucible to produce composites with high weight percentages of additives.

During casting, carbides and lubricating phase interact in a manner that forms a stable neutral buoyancy mixture. Theoretically, a ratio of 3.125 parts weight SiC (density 3.2 $g/cm^3$) to 1 part by weight graphite (density 1.8 $g/cm^3$) is added to provide a neutral buoyancy mixture for an aluminum matrix having a density of 2.7 $g/cm^3$. However, in practice it has been discovered that the method provides "homogenous" castings with a variety of weight ratios and particle size distributions.

EXAMPLE 1

150 grams of aluminum-copper alloy 2014 (Al-4.4Cu-0.8Si-0.8Mn-0.5 Mg produced by ALCAN) was melted in a crucible and brought to a temperature of 780° C. 9.94 grams of 200 mesh (74 micron) graphite powder and 34.38 grams of 280 grit (51 micron) silicon carbide powder were stirred into the melt. Both the graphite and silicon carbide particles were almost completely rejected by the melt and the hybrid composite could not be formed. Microstructural examination also showed that no graphite or silicon carbide particles were present in the melt.

This example confirmed that surface treatment of particles prior to casting is advantageous for reducing wetting problems.

EXAMPLE 2

500 grams of aluminum alloy 356 (Al-7Si-0.3 Mg produced by ALCAN) was melted in a crucible and brought to a temperature of 750° C. All aluminum matrix alloys of Examples 1 to 9 used alloys produced by ALCAN. 25 grams of nickel coated graphite powder (50% nickel) and 25 grams of nickel coated silicon carbide powder (60% nickel) were stirred into the melt. The slurry was gravity poured immediately after stirring into permanent molds to make the casting. The casting showed both silicon carbide and graphite particles present in the castings.

This example illustrated that the nickel allows the aluminum to wet the surface of the graphite as per Badia Canadian Pat. No. 900,216. The particle initially at 50% Ni (density 8.0 $g/cm^3$) and 50% graphite (density 1.8 $g/cm^3$) has a specific gravity of 3.0 and is easily wet incorporated into the melt. However, the nickel quickly dissolved in the alloy whereby graphite particles returned to their original density of 1.8 g/cm and floated to the surface of the melt. The overall melt specific gravity of 2.7 was minimally changed by the dissolved nickel which represented 2.4 wt. % of the melt.

EXAMPLE 3

500 grams of aluminum A356-10% SiC composite alloy was melted in a crucible and brought to a temperature of 700° C. 25 grams of nickel coated graphite powder (containing 50% nickel) and 25 grams of nickel coated silicon carbide (60 wt % nickel) was stirred into the alloy to form a slurry. All nickel coated graphite used in the Examples was coated by nickel carbonyl decomposition and was supplied by Novamet. The 50% nickel coated graphite had an average particle diameter of 99 microns according to product specification. Immediately after stirring, the slurry was poured to produce a casting. The casting showed both graphite and silicon carbide particles uniformly distributed throughout the casting.

This example illustrated that less dense graphite particles prevent the more dense SiC particles (S.G.=3.2 g/cm$^3$) from settling and that the SiC particles prevent the graphite particle from rising to the surface of the cast article. The combination of the more dense and less dense particles than the alloy provide a synergistic effect of providing homogeneity in the final cast metal matrix composite in combination with improved wear properties.

EXAMPLE 4

2100 grams of aluminum A356-10% SiC alloy (produced by ALCAN) was melted and brought to a temperature of 725° C. 425 grams of nickel coated graphite (containing 50% nickel) powder was stirred into the melt. Due to exothermic reaction between nickel and aluminum, the melt temperature became 749° C. The melt was degassed with argon until the melt temperature dropped to 730° C. After degassing, the melt was poured into permanent molds to make the casting. Degassing is advantageously used to eliminate superheating and to lower the amount of trapped gases in the molten aluminum. The casting, upon microscopic examination, showed both graphite and silicon carbide particles uniformly distributed throughout the matrix of aluminum 356 alloy which also had $NiAl_3$ phase present.

This Example demonstrated that a metal coated graphite may be added directly to an existing aluminum composite. The ALCAN method of preparation was equivalent to the method disclosed in Skibo, U.S. Pat. No. 4,865,806.

EXAMPLE 5

1500 grams of A356-20% SiC composite was melted and brought to a temperature of 755° C. Then 170 grams of 50% nickel coated graphite was stirred into the melt and the melt temperature was allowed to come to 748° C. The melt became too sluggish for pouring and was allowed to solidify in the crucible.

The solidified melt showed the presence of both silicon carbide and graphite particles very uniformly distributed throughout the matrix of the aluminum alloy. This example demonstrated that above a certain percentage of nickel and silicon carbide and graphite particles, the melts of hybrid composites may become too sluggish for pouring. However, composite alloys may be allowed to solidify in the crucible itself to obtain hybrid composites.

EXAMPLE 6

1500 grams of A356-15% SiC composite was melted and brought to a temperature of 780° C. Then 170 grams of nickel coated graphite with 25% nickel was stirred into the melt. The 25% nickel coated graphite had an average particle size of 95 microns according to product specification. The melt did become viscous, but it could be poured into a mold. The casting showed presence of both graphite and silicon carbide particles. This example demonstrates that if nickel content and total volume percentage of graphite and silicon carbide is kept below critical levels the melts can be poured.

EXAMPLE 7

5500 grams of A356-10% SiC composite was melted in a crucible and brought to a temperature of 760° C. 1800 grams of nickel coated graphite with 50% nickel was stirred into the melt. The slurry was immediately poured into a mold to form a casting. The casting showed the presence of both graphite and silicon carbide particles. This example illustrated that the method of the invention may be readily scaled up for commercial operations.

EXAMPLE 8

In this example, A356 aluminum-10% SiC, A356 aluminum-20% SiC, Al-Si-5 nickel coated graphite (containing 50% nickel), and Al-Si-10% silicon carbide-10% nickel coated graphite (containing 50% nickel) composites were identically melted and poured into identical cylindrical crucibles placed in a furnace. They were held in molten state for fixed periods up to 60 minutes, and then taken out of the furnace and allowed to solidify. The ingots were examined for flotation and settling of particles. Comparisons were made on settling and flotation of particles and lengths of denuded zones after similar holding periods.

In the Al-Si-5-nickel coated graphite alloy, nickel had dissolved and most of the graphite had floated to the top of the ingot, leaving a graphite-free denuded zone at the bottom. In the A356-10% SiC and A356-20% SiC composite alloys the silicon carbide particles had settled to the bottom of the ingot, leaving a carbide-free denuded zone near the top of the ingot. In the hybrid composites containing both the graphite arising from nickel coated graphite and silicon carbide particles, the distribution of both the particles was much more uniform along the height of the ingot, indicating that the problem of flotation of graphite and settling silicon carbide is considerably reduced when graphite and silicon carbide particles are simultaneously present in the melt.

EXAMPLE 9

Ni-coated graphite (NiGr) particulate (50 wt % Ni, approximately 90% of the particles having a size ranging from about 63 to 106μm) was stirred into an aluminum alloy (A356)-20 vol % SiC composite and chill cast. A typical microstructure of the resulting hybrid composite containing 10 vol % NiGr contained graphite particles, silicon carbide particles and nickel aluminides uniformly distributed throughout an aluminum-base matrix. Boat 3% and 10% NiGr containing samples were tested in dry sliding wear in accordance with "Standard Practice for Ranking Resistance of Materials to Sliding Wear Using Block-on-Ring Wear Test," G77, Annual Book of ASTM Standards, ASTM, Philadelphia, Pa., 1984 pp. 446–62. Referring to FIG. 1, at loads up to 180N, the addition of graphite resulted in a net increase in wear rate. This may have resulted from a decrease in hardness of the block composite material with respect to 20% SiC reinforced aluminum and an overall loss in strength with the addition of graphite particles. However, wear rates of the SiC/NiGr hybrid composite increase linearly at loads above 320N, while wear rates of SiC and NiGr composite increase exponentially at loads less than 320N. The SiC/NiGr hybrid composites have been found to decrease dry wear rate by a factor greater than 100 at a load of 320N in comparison to either the SiC or the Ni - carbon fiber paper reinforced Al alloys. At higher loads up to 440N, the hybrid material exhibited even greater improvement in its wear resistance over either the SiC or the Ni-carbon fiber paper comparison composites. The reason for this behavior is unclear, however the reduced friction at the surface of the hybrid materials; due to the lubricity of a graphite film results in a lower steady state temperature rise of the block sample. This temperature difference between SiC reinforced and hybrid SiC - NiGr composites has been measured under similar testing conditions to be on the order of 40° C. for substrate temperatures approaching 200° C. at high load. As the yield strength of aluminum alloys decreases rapidly at these temperatures, the loss in matrix strength is thought to be the principle reason for the large increase in wear rates of particulate reinforced composites at high load.

In summary, the aluminum alloy-metal coated-graphite-silicon carbide composites made using the processes of this invention facilitate elimination of segregation of particles inherent in either aluminum-graphite and aluminum-silicon carbide particle composites. The process of the invention provides for flexible and commercially acceptable neutral buoyancy casting processes wherein the alloy may be held without segregation problems. The process has been found to operate effectively with a variety of particle sizes, and weight ratios of carbide particulate to carbon phase. In addition, the hybrid aluminum-silicon carbide-graphite composite has advantageous properties not exhibited by either aluminum-graphite or aluminum-silicon carbide composites. The addition of nickel-aluminide precipitates within the aluminum-base matrix of the silicon carbide-graphite composite further increases hardness of the composite. The increased hardness arising from nickel-aluminide precipitates is believed to further increase wear resistance of the metal matrix composite. Under high load conditions, the hybrid composite has reduced dry wear rates in excess of two orders of magnitude. The presence of graphite reduces the friction coefficient of aluminum-silicon carbide composites and makes them more suitable for antifriction applications like brake rotors and engine liners.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The invention claimed is:

1. A method of forming an aluminum-base composite comprising:

a) introducing 5 to 30 weight percent carbide particles into a molten aluminum-base alloy, said carbide particles being selected from the group consisting of silicon carbide, titanium carbide, tungsten carbide, vanadium carbide and a mixture therof;

b) introducing 0.5 to 30 weight percent nickel-coated lubricating phase particles into said molten aluminum-base alloy to form a molten aluminum-base mixture containing nickel dissolved from said nickel-coated lubricating phase particles, said nickel-coated lubricating phase particles being a material selected from the group consisting of carbon, graphite and a mixture thereof;

c) forming a neutral buoyancy mixture by distributing said carbide particles and said lubricating phase particles within said molten aluminum-base alloy; and d) solidifying said neutral buoyancy mixture in a mold to form the aluminum-base composite containing an aluminum-base matrix, carbide particles, nickel aluminide dispersoids and lubricating phase particles.

2. The method of claim 1 including the additional steps of precipitating said nickel aluminide dispersoids in said aluminum-base mixture prior to said solidifying of said aluminum-base mixture.

3. The method of claim 2 including the additional step of: cooling said aluminum-base mixture after dissolution of nickel into said aluminum-base mixture to reduce superheating of said aluminum-base mixture.

4. The method of claim 1 wherein nickel-coated silicon carbide particles are introduced into said molten aluminum-base alloy.

5. The method of claim 1 wherein 5 to 30 weight percent silicon carbide is introduced into said aluminum-base alloy.

6. The method of claim 1 wherein 2 to 20 weight percent graphite is introduced into said aluminum-base alloy.

7. The method of claim 1 wherein 5 to 30 weight percent silicon carbide and 2 to 20 weight percent graphite are introduced into said molten aluminum-base alloy.

8. The method of claim 1 including the additional step of holding said neutral buoyancy aluminum-base mixture without mixing said neutral buoyancy aluminum-base mixture prior to said solidifying of said aluminum-base mixture.

9. The method of claim 1 including the additional step of degassing the melt prior to said solidifying of said aluminum-base mixture.

10. A method of forming an aluminum-base composite comprising:

a) introducing 5 to 30 weight percent carbide particles into a molten aluminum-base alloy, said carbide particles being selected from the group consisting of silicon carbide, titanium carbide, tungsten carbide, vanadium carbide and a mixture therof;

b) introducing 0.5 to 30 weight percent nickel-coated lubricating phase particles into said molten aluminum-base alloy to form a molten aluminum-base mixture containing nickel aluminide dispersoids formed with nickel dissolved from said nickel-coated lubricating phase particles, said nickel-coated lubricating phase particles being a material selected from the group consisting of carbon, graphite and a mixture thereof;

c) forming a neutral buoyancy mixture by distributing said carbide particles, said nickel aluminide dispersoids and said lubricating phase particles within said molten aluminum-base alloy; and d) solidifying said neutral buoyancy mixture in a mold to form the aluminum-base composite containing an aluminum-base matrix, carbide particles, nickel aluminide dispersoids and lubricating phase particles.

11. The method of claim 10 including the additional step of: cooling said aluminum-base mixture after dissolution of nickel into said aluminum-base mixture to reduce superheating of said aluminum-base mixture.

12. The method of claim 10 wherein nickel-coated silicon carbide particles are introduced into said aluminum-base alloy.

13. The method of claim 10 wherein 5 to 30 weight percent silicon carbide is introduced into said aluminum-base alloy.

14. The method of claim 10 wherein 2 to 20 weight percent graphite is introduced into said aluminum-base alloy.

15. The method of claim 10 wherein 5 to 30 weight percent silicon carbide and 2 to 20 weight percent graphite are introduced into said molten aluminum-base alloy.

16. The method of claim 10 including the additional step of holding said neutral buoyancy aluminum-base mixture without mixing said neutral buoyancy aluminum-base mixture prior to said solidifying of said aluminum-base mixture.

17. The method of claim 10 including the additional step of degassing the melt prior to said solidifying of said aluminum-base mixture.

* * * * *